US011312547B2

(12) United States Patent
Siegenthaler

(10) Patent No.: US 11,312,547 B2
(45) Date of Patent: Apr. 26, 2022

(54) CLOSURE FOR A DRINKING BOTTLE

(71) Applicant: SIGG Switzerland Bottles AG, Frauenfeld (CH)

(72) Inventor: Simon Siegenthaler, Pfeffikon LU (CH)

(73) Assignee: SIGG SWITZERLAND BOTTLES AG, Frauenfeld (CH)

( * ) Notice: Subject to any disclaimer, the term of this patent is extended or adjusted under 35 U.S.C. 154(b) by 0 days.

(21) Appl. No.: 16/967,566

(22) PCT Filed: Feb. 7, 2018

(86) PCT No.: PCT/EP2018/053101
§ 371 (c)(1),
(2) Date: Aug. 5, 2020

(87) PCT Pub. No.: WO2019/154495
PCT Pub. Date: Aug. 15, 2019

(65) Prior Publication Data
US 2021/0086963 A1 Mar. 25, 2021

(51) Int. Cl.
*B65D 47/24* (2006.01)
*A45F 3/16* (2006.01)
(Continued)

(52) U.S. Cl.
CPC ..... *B65D 47/248* (2013.01); *A45F 3/16* (2013.01); *A47G 19/2272* (2013.01);
(Continued)

(58) Field of Classification Search
CPC .... B65D 47/249; B65D 47/248; B65D 23/46; B65D 47/245; B65D 2543/00046; B65D 51/18; B65D 2251/1016; A47G 19/2272
(Continued)

(56) References Cited

U.S. PATENT DOCUMENTS 8,360,258 B2 * 1/2013 Gilbert ..... B65D 47/32 220/254.9
8,844,762 B2 * 9/2014 Chiou ..... B65D 43/22 220/715
(Continued)

FOREIGN PATENT DOCUMENTS

EP 3009053 A1 4/2016
JP S62166729 U 10/1987

OTHER PUBLICATIONS

International Search Report for PCT/EP2018/053101 dated Dec. 7, 2018.
Written Opinion for PCT/EP2018/053101 dated Dec. 7, 2018.

*Primary Examiner* — Don M Anderson
*Assistant Examiner* — Jennifer Castriotta
(74) *Attorney, Agent, or Firm* — Pearne & Gordon LLP

(57) ABSTRACT

A closure for a drinking bottle, including a securing element for releasably arranging the closure on a lid of the drinking bottle, a pretensioned pivot element which is arranged on the securing element so as to be pivotable away from said clamping element about a pivot axis, and a seal which is arranged on a pivot element that pivots out. The securing element includes a first clamping element, a second clamping element and a spring. The two clamping elements are arranged on one another so as to be linearly displaceable in one direction and the spring is arranged between the two clamping elements in the direction of displacement.

15 Claims, 3 Drawing Sheets

(51) Int. Cl.
*B65D 43/26* (2006.01)
*A47G 19/22* (2006.01)

(52) U.S. Cl.
CPC ..... *B65D 43/26* (2013.01); *B65D 47/249* (2013.01); *B65D 2543/00046* (2013.01)

(58) Field of Classification Search
USPC ..... 220/715
See application file for complete search history.

(56) References Cited

U.S. PATENT DOCUMENTS

| | | | | |
|---|---|---|---|---|
| 9,913,552 | B2 * | 3/2018 | Elsaden | B65D 47/249 |
| 2014/0197170 | A1 * | 7/2014 | Carlile | B65D 47/249 220/262 |
| 2015/0060448 | A1 * | 3/2015 | Coon | B65D 55/02 220/254.1 |
| 2016/0106241 | A1 | 4/2016 | Wong | |

* cited by examiner

CLOSURE FOR A DRINKING BOTTLE

FIELD OF THE INVENTION

The present invention relates to a closure for a drinking bottle, in particular a closure which is easy to clean.

DESCRIPTION OF THE PRIOR ART

Prior-art closures for drinking bottles are well known and are used in the leisure and sports sector. Such closures are located in the lid of a drinking bottle and can release or close an opening in the lid by actuation. The fact that the beverage must pass through the closure to reach the opening causes the closure to be wetted by the beverage. Conventional closures, however, are difficult to clean or only with increased mounting effort.

DESCRIPTION OF THE INVENTION

It is an object of the present invention to provide a closure for a drinking bottle which is easy to clean.

This object is solved by a closure with the features of claim 1. Further embodiments of the closure, a lid with such a closure, and a drinking bottle with such a closure are defined by the features of further claims.

A closure for a drinking bottle according to the invention comprises a securing element for the releasable arrangement of the closure on a lid of the drinking bottle, a pretensioned pivot element which is arranged on the securing element so as to be pivotable away from the securing element about a pivot axis, a seal which is arranged on a pivot element end that pivots out, wherein the securing element comprises a first clamping element, a second clamping element and a spring, wherein the two clamping elements are arranged on one another so as to be linearly displaceable in one direction, and wherein the spring is arranged between the two clamping elements in the direction of displacement. In this design, the two clamping elements can be easily pressed together, making it easy to remove the closure from the lid. The closure forms an easily removable unit which is easy to clean.

The clamping elements and the pivot element can be made of a heat-resistant food-grade plastic, such as polypropylene. For example, these elements can be injection-molded parts which are manufactured in one piece.

The seal can be formed removably at the pivot element end that pivots out or it can be formed in one piece with the pivot element. The seal can be made of food-grade silicone, TPE or TPR.

In one embodiment, each of the two clamping elements comprises a latching element, which together prevent that the two clamping elements can be separated from each other in the direction of displacement. The components of the closure thus form an inseparable unit, which means that no parts can be lost, for example when cleaning the closure. The latching elements can be designed in such a way that they cannot be separated from each other non-destructively or they can be designed in such a way that the latching elements can be separated from each other by applying a force in a direction perpendicular to the direction of displacement, whereby the clamping elements can be separated from each other. The latching elements can be integrally formed together with the other elements of the clamping elements.

In one embodiment, one of the latching elements is a recess and the other of the latching elements is a tab with a latching nose and wherein the tab is displaceable in the direction of displacement until it stops against the latching nose in the recess. The recess is dimensioned in such a way that the tab with the latching nose can be easily inserted. For this purpose, a bevel may be provided on the side of the latching nose directed towards the free end of the tab. The latching nose can extend over the entire width of the tab. A partial extension is also possible. A bevel can be provided on the side of the recess directed towards the other clamping element to facilitate insertion of the latching nose. The recess can be formed on the first clamping element and the tab with the latching nose on the second clamping element or vice versa.

In one embodiment, the first clamping element comprises at least one guide web and the second clamping element comprises at least one guide groove, wherein the at least one guide web is displaceable in the displacement direction in the at least one guide groove. This design enables precise guidance in the direction of displacement and prevents the clamping elements from misaligning against each other. The guide web can be formed on the first clamping element and the guide groove on the second clamping element or vice versa. The web and the guide groove can be integrally formed together with the other elements of the clamping elements.

In one embodiment, the first clamping element comprises two guide webs facing each other and the second clamping element comprises two guide grooves facing away from each other. With this design, only a movement of the clamping elements in the direction of displacement is permitted and a movement perpendicular to it is essentially prevented.

In one embodiment, the pivot element is arranged on the first clamping element and pretensioned by a spring arranged between the first clamping element and the pivot element. The pretensioning can be realized by means of a torsion spring in the area of the pivot axis or by means of a compression spring, for example a spiral spring, which acts in the area of the pivot element end that pivots out. The spring acting between the two clamping elements can also be a spiral spring. For example, the two springs can be designed identically, which reduces the number of different components. However, other conventional springs can also be used.

The first clamping element may include a spring receptacle which is directed towards the second clamping element, the second clamping element may include a spring receptacle which is directed towards the first clamping element. For example, the spring receptacles can be receiving pins around which a spring can be detachably arranged. The receiving pins prevent the spring from slipping sideways or buckling. Alternatively, the spring receptacles can be designed as sleeves into which a spring can be inserted. In the area of the pivot element end that pivots out, such spring receptacles can also be provided on the first clamping element and on the pivot element in order to position and guide the corresponding spring.

In one embodiment, a pusher is provided on each of the clamping elements, which extends substantially in a plane which is perpendicular to the direction of displacement and which is designed in such a way that at least one fingertip of a user can be placed thereon. The closure can thus be easily removed from the drinking bottle lid by pressing the two pushers together with two fingers. The pushers may also be designed so that two or more fingertips can be placed against them. The pushers can be integrally formed together with the corresponding clamping element.

In one embodiment, the first clamping element comprises a projection which is arranged on a side facing away from the second clamping element and the second clamping element comprises a projection which is arranged on a side facing away from the first clamping element. Each projection can be inserted into a recess provided for this purpose in the lid, as a result of which the closure can be inserted into the lid in a secure and twist-proof manner. The projection can extend over the entire width of the corresponding clamping element. A partial extension is also possible, wherein the projection can be formed in a continuous manner or with interruptions. The projection can be integrally formed together with the other elements of the clamping elements.

In one embodiment, the pivot element is essentially U-shaped and comprises a first web and two legs adjoining it laterally, wherein the free ends of the legs surround the pivot axis. The U-shape is a light and permeable design, which allows liquid which passes through the closure in the direction of the drinking opening during drinking to pass back through the closure into the drinking bottle essentially unhindered after drinking. In addition, the free legs are at least partially elastic, which makes it easier to insert the bearing elements of the pivot element. For example, the bearing elements are laterally outwardly projecting pins, which are inserted into corresponding receptacles in the first clamping element. During assembly, the two legs can be pressed together and can be released again after positioning the pins in the corresponding receptacles.

The first clamping element may comprise tabs which protrude from the first clamping element in the direction of the pivot element. In the end area of the tabs, pin receptacles in the form of through holes can be provided.

In the area of the web, on the side facing away from the first clamping element, a seal receptacle can be provided around which the seal of the drinking opening can be arranged. For example, it can comprise a narrower neck area and a wider head area, wherein the seal can be slipped over the head area and engage in the neck area. With this design, the seal can be easily detached and securely positioned on the pivot element. The dimensions of the seal essentially correspond to those of the drinking opening. The dimensions of the seal receptacle essentially correspond to those of the seal, minus the corresponding wall thickness of the seal.

In one embodiment, the pivot element comprises a further web, which connects the two legs with a distance from the first web. This further web can be actuated, whereby the pivot element can be pivoted against the first clamping element, thus releasing the drinking opening. Since the two webs do not form a closed structure, liquid can also flow through the closure in this area of the closure in an essentially unhindered manner. When the pivot element is pivoted out, the surface of the other web can be inclined with respect to the direction of displacement of the actuation.

The aforementioned embodiments of the closure can be used in any combination, provided they do not contradict each other.

A lid for a drinking bottle according to the invention comprises a lid with a housing in which a drinking opening is formed, a closure which can be removed from the lid and with which the drinking opening can be closed or released, an actuating arrangement with which the closing or release of the drinking opening can be effected by the closure, the closure comprises a closure according to the invention, and wherein the closure can be removed from the lid by pressing the two clamping elements together in the direction of displacement. With the seal of the closure the contour of the drinking opening can be covered from the inside and thus the drinking opening can be closed. The lid may have at least one recess on the inside into which the projections of the closure can be inserted. A continuous circumferential recess can be provided or two mutually separate recesses can be provided. One recess may be formed in the area below the drinking opening in the lid housing and the other recess may be provided in the area of a pusher of the actuating arrangement.

In one embodiment, the actuating arrangement comprises a pusher with a plunger arranged thereon, wherein the plunger is arranged in the lid housing so as to be linearly displaceable and wherein the closure and the actuating arrangement are arranged in the lid in such a way that the plunger is displaceable in a plane which is substantially perpendicular to the pivot axis of the pivot element. The pusher and the plunger can be formed together in one piece. An insertable guide in which the plunger can be guided may be provided in the lid. The plunger may be fitted with seals that prevent liquid from the inside of the bottle from escaping along the plunger.

In one embodiment, the plunger can engage the pivot element of the closure and the release of the drinking opening can be effected by pressing the pusher. The actuating arrangement may include a spring which causes the plunger together with the pusher to be pushed away from the pivot element and the drinking opening to remain closed by the seal.

In one embodiment, the lid also includes a blocking device which prevents the actuating arrangement from shifting. For this purpose, a recess is provided in the plunger of the actuating arrangement, in which a nose of the blocking device can engage. The nose can only engage in the recess when the plunger is in the extended position, i.e. in the position furthest away from the drinking opening. The blocking device can be held in this position with a clamping element.

The aforementioned embodiments of the lid can be used in any combination, provided they do not contradict each other.

A drinking bottle according to the invention with a removable lid comprises a lid with a closure in accordance with the invention.

BRIEF DESCRIPTION OF THE DRAWINGS

Exemplary embodiments of the present invention are explained in more detail below using the figures. These serve only for explanation and are not to be interpreted restrictively, wherein.

DETAILED DESCRIPTION OF THE INVENTION

Figure 1:
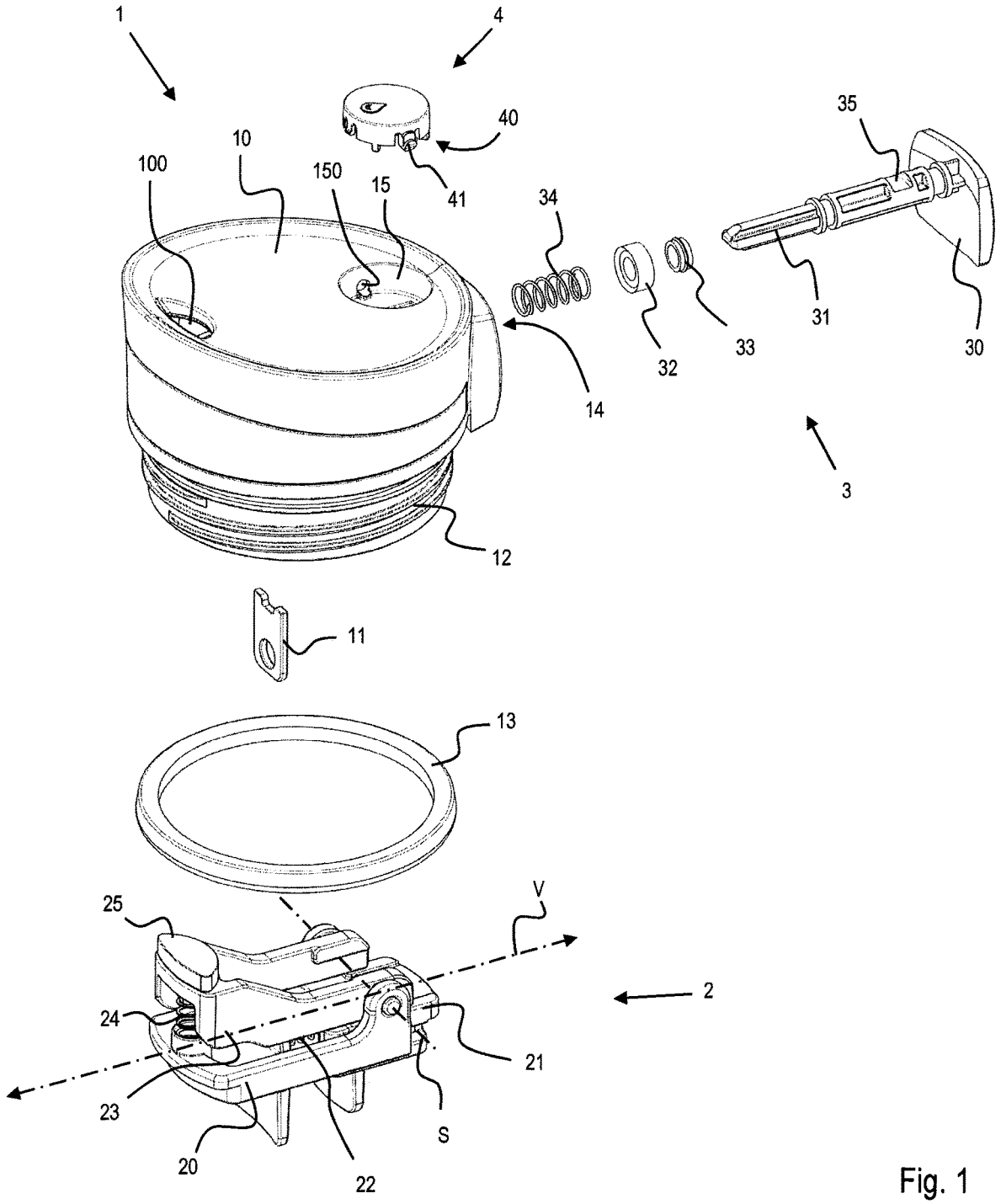
FIG. 1 shows an exploded view of a lid with a closure according to the invention.

FIG. 1 shows an exploded view of a lid 1 with a closure 2 according to the invention. The lid 1 comprises a lid housing 10 with a drinking opening 100, a slide-in guide 11, an external thread 12 for screw connection with a drinking bottle, a receptacle 14 for an actuating arrangement 3 and a receptacle 15 for a blocking device 4 with which a displacement of the actuating arrangement 3 can be prevented.

Closure 2 comprises a first clamping element 20, a second clamping element 21, a spring 22 arranged between the clamping elements 20, 21 and acting thereon, a pivot element 23 which is arranged on the first clamping element 20 so as to be pivotable about a pivot axis S, a spring 24 arranged between the first clamping element 20 and the pivot element 23 and acting thereon, and a seal 25 arranged at the end of the pivot element 23 that pivots out.

The actuating arrangement 3 comprises a pusher 30 with an adjoining plunger 31, with the plunger 31 extending substantially vertically from the pusher. The actuating arrangement 3 further comprises an inner seal 32 and an outer seal 33 with which the plunger 31 can be sealed against the lid housing 10. Furthermore, actuating arrangement 3 comprises a return spring 34 with which the plunger 31 and thus the pusher 30 is pressed outwards.

Blocking device 4 comprises pins 41 with which it is mounted in a tiltable manner in recesses 150 in the blocking receptacle 15. Furthermore, the blocking device 4 comprises a tab 40 with which the displacement of the actuating arrangement 3 can be prevented.

Furthermore, a seal 13 is shown, which can be placed above the thread 12 on the outer circumference of the lid 1.

Figure 2:
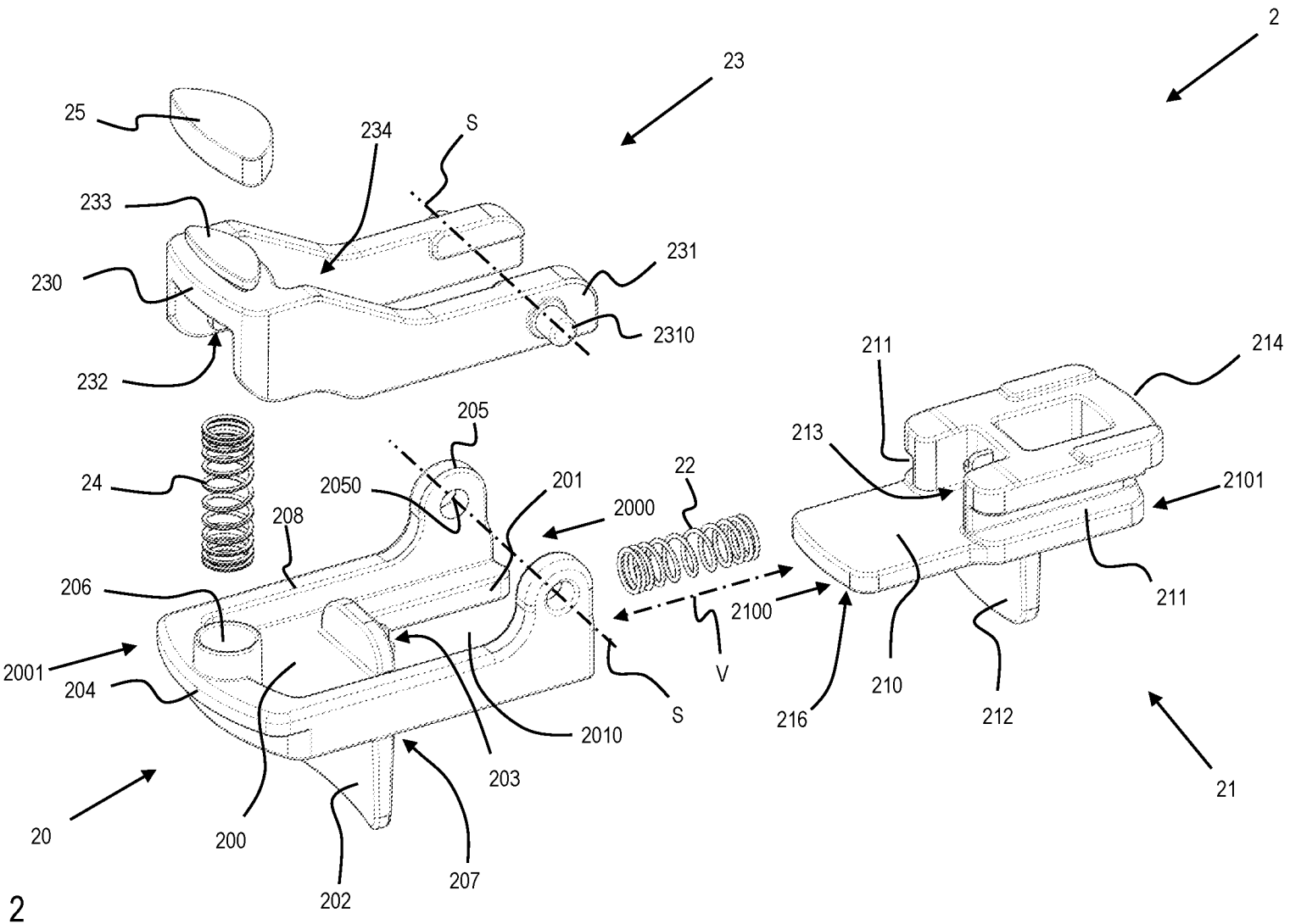
FIG. 2 shows an exploded view of the closure of FIG. 1.
Figure 3:
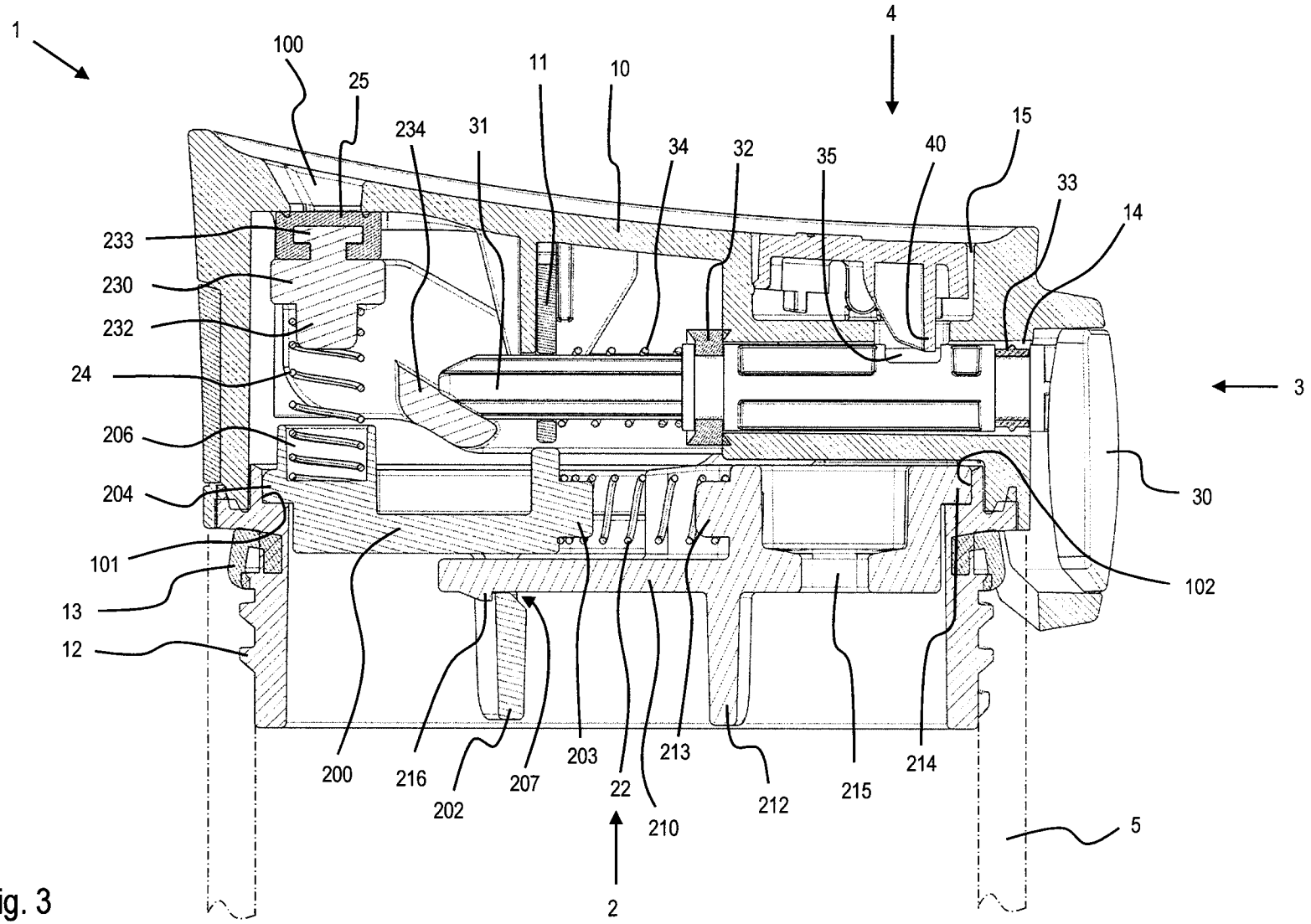
FIG. 3 shows a sectional view of the lid with the closure according to the invention as shown in FIG. 1 in the assembled state.

FIG. 2 shows an exploded view of closure 2 of FIG. 1 The first clamping element 20 comprises a substantially four-sided plate 200, on the first side 2000 of which two mutually spaced guide webs 201 extend. The guide webs 201 adjoin the adjacent sides of the plate 200. A wall 208 adjoining the plate 200 extends substantially perpendicularly away from the plate 200 and along a second side 2001 opposite the first side 2000 and the adjoining sides, including the guide webs 201. At the outer free end of the guide webs 201, the wall 208 extends even further away from the plate 200 and forms a tab 205 in which pin receptacles 2050 are formed in the form of through holes. The central axis of the pin receptacles 2050 form the pivot axis S. A recess 2010 is formed between the two guide webs 201 and the guide webs 201 are arranged opposite each other with respect to this recess 2010. On the first side 2000 of the plate 200, between the two guide webs 201, a pusher 202 extends substantially perpendicularly to the plate 200 on the one side of the plate substantially at the same distance as the wall 208 and on the opposite side in such a way that at least one fingertip of a user can engage it. On this side of the pusher 202, a recess 207 is formed adjacent to the plate 200, as shown in FIG. 3. On the first side 2000 of the plate 200, between the two guide webs 201, a spring receptacle 203 extends substantially vertically away from the pusher 202. The spring receptacle 203 is designed as a cross pin around which the spring 22 can be arranged. On the second side 2001 of the plate 200, a projection 204 is formed on the upper free edge of the wall 208, which extends away from the first side 2000, essentially parallel to the plate 200. On the second side 2001 of the plate 200, a spring receptacle 206 extends away from the plate 200 in the same direction as the wall 208. The spring receptacle 206 is designed as a sleeve in which the spring 24 can be arranged.

The second clamping element 21 comprised a rectangular body with oppositely disposed guide grooves 211 on two opposite sides. The guide webs 201 of the first clamping element 20 can be moved in the guide grooves 211 of the second clamping element 21 in the displacement direction V. On a first side 2100 of the body, a tab 210 extends from one edge of the body away from it, in alignment with an adjacent surface of the body. On this flush side of the tab 210, a latching nose 216 is formed, as shown in FIG. 3. On the first side 2100 of the body, between the two guide grooves 211, a pusher 212 extends away from the body substantially perpendicular to the body in such a way that at least one fingertip of a user can engage it. On a second side 2101 of the body opposite the first side 2100, a projection 214 is formed on an upper edge of the body, which extends away from the first side 2100 substantially parallel to the tab 210. On the first side 2100 of the body, between the two guide grooves 211, a spring receptacle 213 extends substantially parallel to the guide grooves 211, vertically away from the body. The spring receptacle 213 is also designed as a cross pin.

The pivot element 23 is formed in an essentially U-shaped manner and comprises a web 230 and two adjoining legs 231, which extend essentially vertically away from the web 230. On the sides of the legs 231 facing away from the web 230, pins 2310 are arranged which extend away from each other essentially parallel to the web 230. The central axis of the pins 2310 form the pivot axis S. On a side of the web 230 facing the first clamping element 20, a spring receptacle 232 in the form of a cross pin is formed around which the spring 24 can be arranged. On the side of the web 230 opposite the spring receptacle 232, a seal receptacle 233 is formed. The seal receptacle comprises a narrower neck area adjoining the web 230 and a wider head area adjoining it. The seal 25 can engage around the head area and in the neck area.

FIG. 3 shows a sectional view of the lid 1 with the closure 2 according to the invention and as shown in FIG. 1 in the assembled state. The lid 1 can be screwed with its external thread 12 onto a correspondingly designed bottle 5, wherein the seal 13 is located in the assembled state between the bottle 5 and the lid 1 and accordingly seals the inside of the bottle against the environment. The closure 2 is arranged with its outwardly directed projections 204, 214 in corresponding recesses 101, 102. The recesses 101, 102 are formed above the thread 12 in the inside of the lid. The closure 2 is aligned with the lid 1 in such a way that the seal 25 of closure 2 can completely close the drinking opening 100 of lid 1. In the unactuated state, the plunger 31 and the pusher 30 of the actuating device are pressed outwards by the spring 34, whereby the plunger tip clears the way for the further web 234 of the pivot element 23, whereby the pivot element 23 can pivot away from the first clamping element 20 until the seal 25 on the inside strikes against the drinking opening 100. If the pusher 30 is pressed against the inside of the lid by a user, the pusher tip presses down the further web 234 and the seal 25 is pivoted away from the drinking opening 100 about the pivot axis S. To remove the closure 2 from the lid 1, the two pushers 202, 212 of the seal can be pressed together, whereby the projections 204, 214 are moved out of the corresponding recesses 101, 102 in the lid. Thereafter, the closure 2 can be removed as a whole from the lid housing 10. As the clamping elements 20, 21 are held together by the latching elements 207, 216, they will not come loose from each other even after removal from the lid. If the two clamping elements should nevertheless be separated from each other, the tab 210 can be pressed with the latching nose 216 of the second clamping element 21 against the plate 200 of the first clamping element 20, thereby releasing the latching nose 216 and allowing the tab 210 to be extended from the latching recess 207.

LIST OF REFERENCE SIGNS

| | | | |
|---|---|---|---|
| 1 | Lid | 2050 | Pin receptacle |
| 10 | Lid housing | 206 | Spring receptacle |
| 100 | Drinking opening | 207 | Latching recess |
| 101 | Recess | 208 | Wall |
| 102 | Recess | 21 | Clamping element |
| 11 | Guide | 210 | Tab |
| 12 | Thread | 2100 | First side |
| 13 | Seal | 2101 | Second side |
| 14 | Pusher receptacle | 211 | Guide |
| 15 | Blocking receptacle | 21 | Pusher |
| 150 | Recess | 213 | Spring receptacle |
| 2 | Closure | 214 | Projection |
| 20 | Clamping element | | |
| 200 | Plate | 216 | Latching nose |
| 2000 | First side | 22 | Spring |
| 2001 | Second side | 23 | Pivot element |
| 201 | Guide | 230 | Web |
| 2010 | Recess | 231 | Leg |
| 202 | Pusher | 2310 | Pin |
| 203 | Spring receptacle | 232 | Spring receptacle |
| 204 | Projection | 233 | Seal receptacle |
| 205 | Tab | 234 | Web |
| 24 | Spring | 35 | Recess |
| 25 | Seal | 4 | Blocking device |
| 3 | Actuating arrangement | 40 | Nose |
| 30 | Pusher | 41 | Pin |
| 31 | Plunger | 5 | Drinking bottle |
| 32 | Seal | | |
| 33 | Seal | V | Displacement direction |
| 34 | Spring | S | Pivot axis |

What is claimed is:

1. A closure for a drinking bottle, comprising a securing element (20, 21) for detachably arranging the closure on a lid (1) of the drinking bottle, a pretensioned pivot element (23) which is arranged on the securing element (20, 21) so as to enable pivoting away from the latter about a pivot axis, a seal (25) which is arranged at an end of the pivot element (23) that pivots out, characterized in that the securing element (20, 21) comprises a first clamping element (20), a second clamping element (21) and a spring (22), wherein the two clamping elements (20, 21) are arranged on each other so as to be linearly displaceable in one direction and wherein the spring (22) is arranged between the two clamping elements (20, 21) in the displacement direction.

2. The closure according to claim 1, wherein each of the two clamping elements (20, 21) comprises a latching element (207, 216) which together prevent the two clamping elements (20, 21) from being separated from each other in the direction of displacement.

3. The closure according to claim 2, wherein one of the latching elements is a recess (207) and wherein the other of the latching elements is a tab (210) with a latching nose (216) and wherein the tab (210) is displaceable in the direction of displacement in the recess (207) until it abuts against the latching nose (216).

4. The closure according to claim 1, wherein the first clamping element (20) comprises at least one guide web (201) and wherein the second clamping element (21) comprises at least one guide groove (211), wherein the at least one guide web (201) is displaceable in the displacement direction in the at least one guide groove (211).

5. The closure according to claim 4, wherein the first clamping element (20) comprises two guide webs (201) facing each other and wherein the second clamping element (21) comprises two guide grooves (211) facing away from each other.

6. The closure according to claim 1, wherein the pivot element (23) is arranged on the first clamping element (20) and is preloaded by a spring (24) arranged between the first clamping element (20) and the pivot element (23).

7. The closure according to claim 1, wherein a pusher (202, 212) is provided on each of the clamping elements (20, 21), wherein the pusher extends substantially in a plane perpendicular to the direction of displacement and is designed in such a way that at least one fingertip of a user can be applied thereto.

8. The closure according to claim 1, wherein the first clamping element (20) comprises a projection (204) which is arranged on a side facing away from the second clamping element (21) and wherein the second clamping element (21) comprises a projection (214) which is arranged on a side facing away from the first clamping element (20).

9. The closure according to claim 1, wherein the pivot element (23) is substantially U-shaped and comprises a first web (230) and two legs (231) laterally adjoining the latter, and wherein the free ends of the legs (231) comprise the pivot axis (S).

10. The closure according to claim 9, wherein the pivot element (23) comprises a further web (234) which connects the two legs (231) to each other at a distance from the first web (230).

11. A lid for a drinking bottle, comprising a lid (1) with a housing (10) in which a drinking opening (100) is formed, a closure (2) which can be removed from the lid and with which the drinking opening (100) can be closed or released, an actuating arrangement (3) with which the closing or release of the drinking opening (100) can be effected by the closure (2), characterized in that the closure (2) comprises a closure according to claim 1 and the closure (2) is removable from the lid by pressing the two clamping elements (20, 21) together in the direction of displacement.

12. The lid according to claim 11, wherein the actuating arrangement (3) comprises a pusher (30) with a plunger (31) arranged thereon, wherein the plunger (31) is arranged linearly displaceably in the lid housing (10) and wherein the closure (2) and the actuating arrangement (3) are arranged in the lid (1) in such a way that the plunger (31) is displaceable in a plane which is substantially perpendicular to the pivot axis of the pivot element (23).

13. The lid according to claim 12, wherein the plunger (31) can act upon the pivot element (23) of the closure and wherein the release of the drinking opening (100) can be effected by pressing the pusher (30).

14. The lid according to claim 11, wherein the cover further comprises a blocking device (4) with which the displacement of the actuating arrangement (3) can be prevented.

15. A drinking bottle with a removable lid (1) according to claim 11.

* * * * *